United States Patent [19]

Tschan

[11] 4,346,509

[45] Aug. 31, 1982

[54] PROCESS FOR THE INTRODUCTION OF A PIECE OF FOAM PLASTIC INTO A POCKET FITTED TO IT

[75] Inventor: René Tschan, Reinach, Switzerland

[73] Assignee: Lonza Ltd., Gampel, Switzerland

[21] Appl. No.: 194,220

[22] Filed: Oct. 6, 1980

[30] Foreign Application Priority Data

Aug. 22, 1980 [CH] Switzerland ..... 6341/80

[51] Int. Cl.[3] ..... B23P 11/02

[52] U.S. Cl. ..... 29/451; 29/522 R; 2/2; 2/97

[58] Field of Search ..... 29/451, 464, 522 R; 2/97, 94, 272, 2.5, 24, 2 R; 53/117

[56] References Cited

U.S. PATENT DOCUMENTS 1,869,261 7/1932 Jennings ..... 2/94
2,976,539 3/1961 Brown, Jr. ..... 2/2
3,257,666 6/1966 Hoffman ..... 2/2
3,286,435 11/1966 Weinberger ..... 53/117

*Primary Examiner*—Leon Gilden
*Attorney, Agent, or Firm*—Fisher, Christen & Sabol

[57] ABSTRACT

A piece of foam plastic is introduced into a pocket of a life jacket fitted to it and made of flexible material, through an opening formed at the edge of the pocket. The circumference of the opening is shorter than the circumference of the piece of foam plastic. The piece of foam plastic is compressed between two arms in a U-shaped manner and then further compressed until the legs close. The pocket with the extended opening at its front is pushed over the bent piece of foam plastic. The arms, insofar as the opening permits, are spread apart. The pocket together with the piece of foam plastic located therein are pulled off of the two arms. The opening is then sewn up.

4 Claims, 10 Drawing Figures

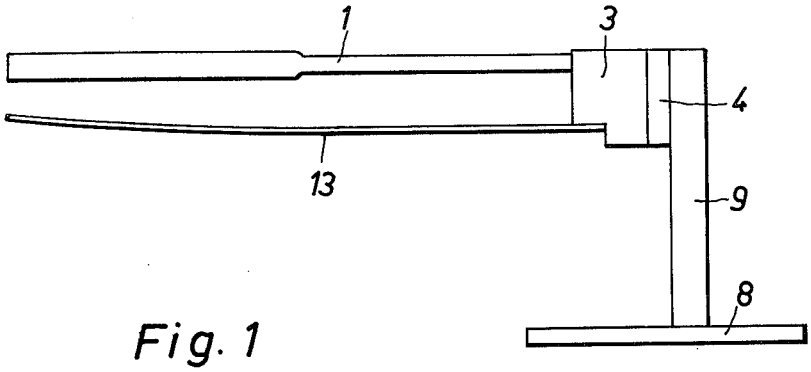
Fig. 1
Fig. 2
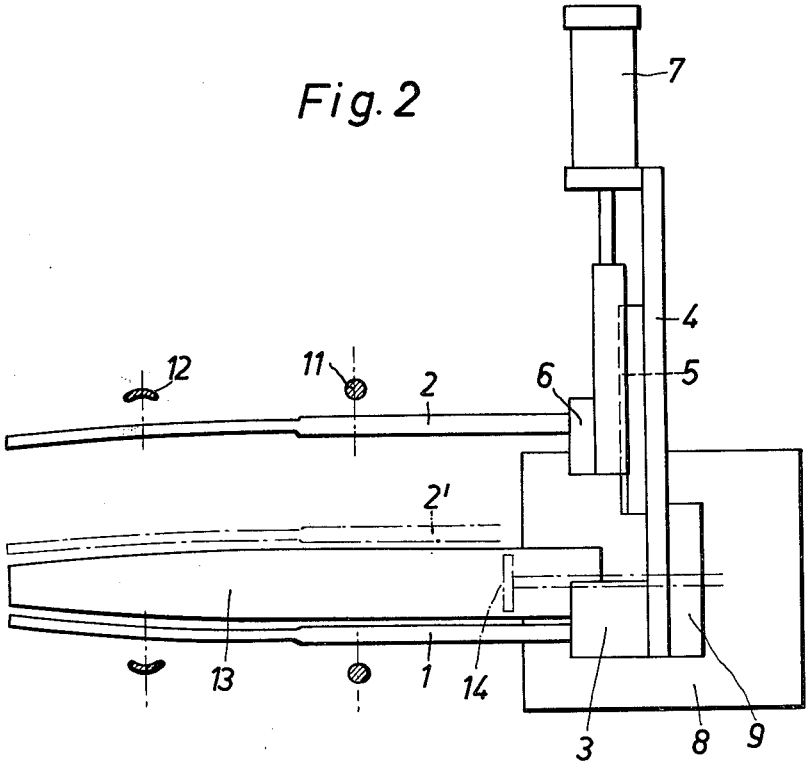

Fig. 3
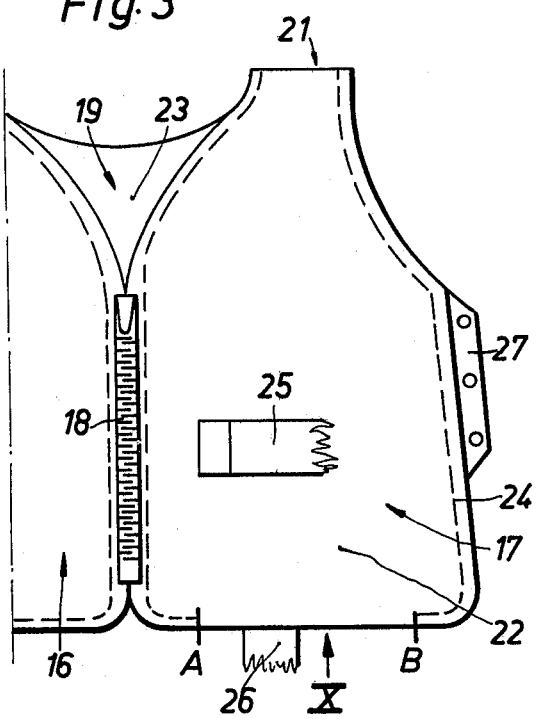
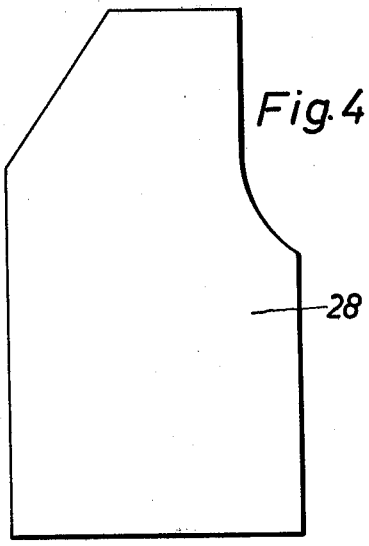
Fig. 4
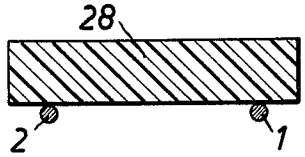
Fig. 5
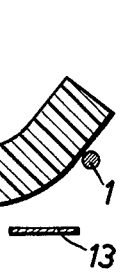
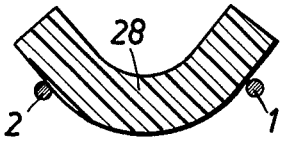
Fig. 6
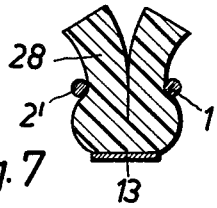
Fig. 7
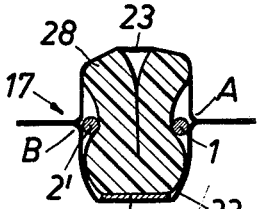
Fig. 8
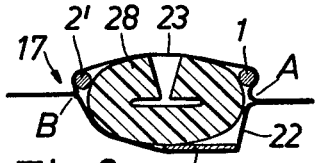
Fig. 9
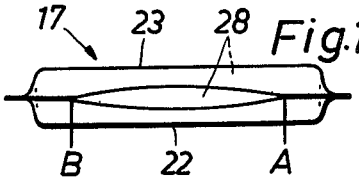
Fig. 10

PROCESS FOR THE INTRODUCTION OF A PIECE OF FOAM PLASTIC INTO A POCKET FITTED TO IT

BACKGROUND OF THE INVENTION

1. Field of This Invention

This invention relates to the field of life vests or life jackets and the process of and apparatus for preparing life jackets.

2. Prior Art

Difficulties are encountered when one attempts to insert an elastically bendable plate-shaped piece of foam plastic into a pocket of flexible material, which is fitted to the piece of foam plastic, through a slit-shaped opening formed at an edge of the pocket where the periphery of the pocket opening is shorter than the periphery of the cross section of the piece of foam plastic when positioned perpendicular to the direction of insertion. The problems are especially encountered whenever the material is relatively stiff in texture and the circumference of the opening of the pocket is considerably smaller than that of the cross-section of the piece of foam plastic (positioned perpendicular to the direction of introduction). Such is particularly the case when inserting closed-celled pieces of foam plastic into the pockets of lifesaving jackets since the pieces of foam plastic have a considerable resistance to flexure. This is so because the pieces of foam plastic are close-called, therefore being not very compressible, and have to be relatively thick in order to achieve the volume which is necessary for the required buoyancy in the water. The insertion of the pieces of foam plastic is also considerably complicated by the fact that the surface of foam plastic, especially the surface of close-called foam plastic, has considerable resistance or friction as it has a very large number of small indentations which adhere firmly to an adjacent surface even in the instance of little contact pressure.

In the production of life jackets and for the formation of the pockets, each of which is to receive one piece of foam plastic, the pieces made of flexible material are first sewn together over a large part of their periphery. The small residual peripheral part forms a slit-shaped opening through which the piece of foam plastic is inserted. The residual peripheral part is then sewn together. In the case of the production process for life jacekts, the slot-shaped opening is formed on a straight side of the pocket, but is sometimes shorter that than side. Each end of the slit is at a distance from the adjacent end (the adjacent corner) of such straight side of the pocket. At the same time the slit-like opening is naturally shorter than the diemsnion of the piece of foam plastic corresponding to this side of the pocket. The difference between the circumference of the slit-like opening (i.e., double the length of the slit) and the circumference of the cross section on the corresponding side of the piece of foam plastic is even more considerable because the thickness of the foam also constitutes a part of the cross sectional circumference. Such quite naturally complicates the insertion of the piece of foam plastic. However the opening, which does not extend to the corners, can after insertion therein of the piece of foam plastic be sewn up more easily and quickly, hence more economically, than an opening which extends from one corner to the other. This is so because the existing part of the seam has already been guided around the corners of the pocket in which the corresponding corners of the piece of foam plastic are then located. In order to understand the easier and quicker sewing up of the opening, one must realize that the piece of foam plastic totally fills the pocket. If the seam had not been sewn around the corners, in order to have the edges of the slit cover each other so they could be sewn together, it would be necessary to deform the piece of foam plastic somewhat at the adjacent end. That is cumbersome because of the limited volume-elasticity of the close-celled foam plastic. But such problem is not encountered whenever the already existing seam has already been completed around the corners and already extends partly in the direction in which it must be completed in order to close the opening. The advantage of the facilitated closing of the opening is considerable, but hardly prevailed hitherto, because it was expensive, cumbersome and time consuming to insert the piece of foam plastic into the pocket through the small opening.

BROAD DESCRIPTION OF THIS INVENTION

An object of this invention is to provide a device and process for inserting a piece of foam plastic into a small slot in a pocket of for example a live jacket. Other objects and advantages of this invention are set out herein or are obvious herefrom to one ordinarily skilled in the art.

The objects and advantages of this invention are achieved by the device and processes of this invention.

This invention includes a process for inserting an elastically bendable platform-like piece made of foam plastic into a pocket, fitted to the piece of foam plastic, through a slit like opening along much of an edge of the pocket. The periphery of the slit-like opening is shorter than the periphery of the cross section, perpendicular to the direction of insertion, of the piece of foam plastic. The piece of foam plastic is bent into the shape of an arc at first obliquely to the direction of insertion. The piece bent thusly is compressed between two arms, which extend in the direction of insertion. The compressed piece is approximately U-shaped in cross section. The bent piece of foam plastic is further compressed until there is at least a partial joining of the legs of the bent piece of foam plastic. The pocket is pulled with its slit-like opening over the bent piece of foam material, which is compressed between the arms. The arms are moved apart. The pocket together with the piece of foam plastic contained therein is pulled off the arms. The pocket is aligned with the piece of foam plastic in as far as the piece of foam plastic has not completely reassumed its original shape. The process of this invention allows carrying out insertion of the piece of foam plastic less assidously, as well as more quickly and thus more economically.

The process of this invention is particularly advantageous where the foam plastic has closed cells. Preferably, upon pulling the pocket with the piece of foam plastic contained therein off of the two arms, a pressure is exerted on the pocket in the direction of pulling off right through the opening.

This invention also includes a device for conducting the process of this invention. The device includes a holder, a first appendage fixedly mounted on the holder and a second movable appendage mounted on the holder. The second movable appendage is movable in relation to the fixed first appendage. There is means for moving the movable second appendage (usually in a straight line along the holder) in relation to (towards and away from) the fixed first appendage. There are two arms which are disposed side by side in the manner of free supports. The first of the arms is attached to the fixed appendage of the holder. The second of the arms is attached to the movable second appendage of the holder, whereby the distance between the two arms can be changed by the means of moving the movable second appendage in relation to the fixed first appendage.

Preferably each of the two arms has a flat cross section on a part thereof away from the place of attachment of each of the arms of the holder and extending up to the free end of each of the arms. The flat sections face each other. The largest dimension of each arm extends at least approximately perpendicularly to the direction of movement of the other arm. The distance between the arms, when in their position of rest, decreases towards their free ends. The arms, when in their operational position, in which they hold the piece of foam plastic in a compressed and buckled state, are at least approximately straight and are parallel to each other due to the effect of the bending movement occurring as a result of the compression and buckling of the piece of foam plastic.

Preferably the flat profile of each arm is a spoon-like profile. The concave or hollow side of the profile of the arms faces each other. Preferably, underneath the arms which are disposed approximately horizontally, a flat approximately-horizontal support is attached to the holder for supporting the area of curvature of the compressed piece of foam plastic. Also, preferably the support rises slightly toward its free end, so that in the working position of the arms where they keep the piece of foam plastic compressed and bent, the raised end part of the support is approximately straight and parallel to the arms as a result of the bending moment exerted thereon by the apex of the bent piece of foam plastic. Preferably a pestle is mounted on the holder. The pestle is guided by the support. The pestle is movable in the longitudinal direction of the two arms to a position approximately in the middle between the fixed arm and the movable arm, when such is in its operational position. Preferably the arms and the support are replaceable with different sized arms and support for adaptation to pieces of foam plastic of various dimensions and elasticity. Also preferably the arms and the support are provided with a coating which increases their slidability property.

This invention also includes the application of the process of this invention to the insertion of the closed-cell pieces of foam plastic into the pockets of life jackets. This invention further includes the application of the device of this invention to the insertion of the closed-cell pieces of foam plastic into the pockets of life jackets.

DETAILED DESCRIPTION OF THIS INVENTION

This invention is explained in more detail in the following description based on the attached drawings which represents the preferred embodiment.

In the drawings:

FIG. 1 shows a side elevational view of a device of this invention for the introduction of a piece of foam plastic into a pocket of flexible material which is fitted to the piece of foam plastic;

FIG. 2 is a top elevational view of the device of FIG. 1;

FIG. 3 is a partial front elevational view of a life jacekt;

FIG. 4 is a front elevational view of a piece of foam plastic for insertion into one of the pockets of the life jacket of FIG. 3;

FIGS. 5 to 9 shows various stages during insertion of the piece of foam plastic of FIG. 4 into a pocket of the life jacket of FIG. 3 by means of the device of FIGS. 1 and 2; and FIG. 10 is a view of the life jacket in the line of vision X in FIG. 3 with an inserted piece of foam plastic and with insertion opening not yet closed.

As shown in FIGS. 1 and 2, two arms 1 and 2 are disposed horizontally side by side in the manner of free supports. Arm 1 is attached to fixed part 3 of holder 4 and arm 2 is attached to movable part 6. Part 6 is shiftable by means of carriage guide 5 on holder 4 to change of its distance from arm 1. Pneumatic piston-cylinder unit 7, which is attached to holder 4, provides the means for shifting part 6. Column 9, mounted on base plate 8, carries holder 4.

Arms 1 and 2 each have circular cross section 11 from the point of their attachment to about the middle of their lenght and have spoon-like cross section 12 up to their free end. The hollow or concave sides of cross sections 12 face each other. Arms 1 and 2, in the region in which their cross section is circular, are parallel and subsequently curve towards each other such that their mutual distance decreases toward their free end. Below the plane in which arms 1 and 2 are disposed, flat support 13 is fastened to part 3. When arm 2 is in operational position 2', shown in FIG. 2 as a dash-dot line, support 13 is in the middle of but below two arms 1 and 2. Support 13 is about as long as arms 1 and 2 and runs horizontally from its point of attachment to about the middle of its length and then bends upwardly. In the area of support 13's longitudinal curvature, support 13 tapers in its width towards its free end. The curvature of arms 1 and 2 and of support 13 is about that corresponding to a bending line.

The device can include pestle 14, indicated as a dash-dot line in FIG. 2. Whenever arm 2 is in its operational position 2', pestle 14 is located in the middle between arms 1 and 2. Pestle 14 can be connected with a thrust (push) arrangement, for example, a piston-cylinder unit (not shown). In order to use pieces of foam plastic of various dimensions and stiffness, various arms 1 and 2, as well as pestle 14, having different lengths, sizes, etc., can interchangeably be used. Also, an adjustable stop can be provided against which part 6 abuts in the operational position of arm 2. Arms 1 and 2 and support 13 can be coated with a layer having the property of high slidability in order to facilitate the processes described in connection with FIGS. 8 and 9.

Concerning the life jacket partly shown in FIG. 3, one must distinguish between two symmetrical front parts (chest parts) 16 and 17. Front parts 16 and 17 are releasably interconnected by zipper 18. Front parts 16 and 17 are also connected by backpart 19, which is visible in FIG. 3 only in the neck cut-out. Front parts 16 and 17 follow back part 19 in shoulder area 21. The life jacket consists essentially of two equal parts, sewn together at their edges, of flexible especially textile material. In FIGS. 3 and 7 to 10, the piece forming the outside of the life jacket is designated by 22 and the piece forming the inside is designated by 23. Pieces 22 and 23 form the walls of the pockets and are interconnected at their edges by seam 24, shown as a broken line in FIG.

3. Partially shown belts 25 and 26 and four ribbons 27 having eyelets in front parts 16 and 17 are tied together with back part 19 under the arms of the person wearing the life jacket for the secure attachment of the life jacket to such person. (Belts 25 and 26 and ribbons 27 are not shown in FIG. 10.) Each of parts 16, 17 and 19 constitutes a pocket in which there is a close-celled piece of foam plastic. For example, piece 28 of foam plastic shown in FIG. 4 is inserted into front part 17 shown at the right in FIG. 3. In order to insert piece 28 of foam plastic into front part 17, seam 24 at its lower edge is formed at first only to points A and B. As a result, a slit-like opening is formed between points A and B. The slit-like opening is shorter than the lower width of piece 28 of foam plastic. The circumference of the slit-like opening is shorter to an even greater degree, as explained above, than the circumference of the cross section at the lower side of piece 28 of foam plastic.

In order to introduce piece 28 of foam plastic through opening A-B into pocket-forming front part 17 of the life jacket, the device (described in connection with FIGS. 1 and 2) is used as follows.

Piece 28 of foam plastic is placed lengthwise onto arms 1 and 2, whereby arm 2 is in its rest position, that is, its pulled out state as shown in FIG. 2. FIG. 5 shows this arrangement in cross section. Then piece 28 of foam plastic is pressed downward between arms 1 and 2 (see FIG. 6) and arm 2 is pushed into its operational position 2'. As a result, piece 28 of foam plastic (as FIG. 7 shows) is bent into a U-shaped cross section, the legs of the U are partly compressed and the apex of the bend is pressed against support 13. At the same time the return force of bent-and-compressed piece 28 of foam plastic exerts a bending moment on arms 1 and 2' as well as on support 13. Under the effect thereof, arms 1 and 2' and support 13 straighten out into a straight and parallel state. If arms 1 and 2' and support 13 were made so that they were straight, they would have to be very flexure or bend resistant in order to withstand the bending moments and would have to remain in parallel. This would require greater cross sections for arms 1 and 2 and support 13, which because of limited opening A-B would be highly undesirable in the case of the processes described in connection with FIGS. 8 and 9. Now the pocket of the life jacket forming front part 17 is pushed via opening A-B onto piece 28 of foam plastic, which is wedged together between arms 1 and 2' and support 13, until piece 28 is entirely within the pocket. See FIG. 8. Thereupon arm 2' is pushed away as far as possible from arm 1—see FIG. 9. Then front part 17, with piece 28 of foam plastic contained therein, is pulled off of arms 1, 2 and support 13. This extraction process can be assisted by pestle 14 (FIG. 2). Normally, inside piece 23 is net-like. While front part is in the position where piece 23 is on top, front part 17 is pushed onto piece 28 of foam plastic (which is compressed between arms 1 and 2' and carrier 13). As a result, piece 28 of foam plastic is visible through the interstices of piece 23 and piece 28 can be aligned during the process of pulling off front piece 17.

In the state shown in FIG. 8, piece 28 of foam plastic is compressed firmly between arms 1 and 2' and support 13 and is practically unshiftable or unmovable on arms 1 and 2' and support 13. At the same time, the surface area of piece 28 of foam plastic which the walls of pockets 22, 23 contact is relatively small. As a result, piece 28 of foam plastic is held firmly in place and the pocket (front part 17) slides as well as possible onto piece 28 of foam plastic. This makes it easier to pull pocket 17 over piece 28 of foam plastic.

In the state shown in FIG. 9, where the two parts have been moved apart, the bent parts of piece 28 of foam plastic are held together considerably more loosely by arms 1, 2 and support 23. Thus, piece 28 is more easily shiftable or movable along arms 1 and 2 and surface 13. At the same time, the surface area of piece 28 which the walls of pockets 22, 23 contact is relatively large. As a result, whenever the pocket (front part 17) together with piece 28 of foam plastic contained therein are pulled off arms 1 and 2 and support of the device, piece 28 of foam plastic is carried along by adhesive friction with pocket walls 22, 23 and thereby slides off of arms 1 and 2 and support 23. This factor facilitates the removal process.

Finally, seam 24 between points A and B is completed. Pieces of foam plastic adapted to the other pockets are inserted in a corresponding manner into the other pockets (which form front part 16 and back part 19). Such pieces of foam plastic are held firmly in place upon completion of seam 24 at the corresponding points in the life jacket. However, the process and the device of this invention are not limited to this application and use relating to life jackets because the problem described does not only exist with them. The detailed description related to life jackets is not meant to limit the scope of this invention. FIGS. 1 to 10 shows the preferred embodiment of this invention.

What is claimed is:

1. Process for the insertion of an elastically bendable platform-like piece made of foam plastic into a pocket, fitted to the piece of foam plastic, through a slit-like opening along much of an edge of the pocket, the periphery of the slit-like opening being shorter than the periphery of the cross section, perpendicular to the direction of insertion, of the piece of foam plastic, comprising bending the piece of foam plastic into the shape of an arc at first obliquely to the direction of insertion, compressing the piece bent thusly between two arms, which extend in the direction of insertion, the bent piece being approximately U-shaped in cross section, compressing further the bent piece of foam plastic until there is at least partial joining of the legs of the bent piece of foam plastic, pulling the pocket with its spread slit-like opening over the bent piece of foam material, which is compressed between the arms, moving apart the arms, and pulling the pocket together with the piece of foam plastic container therein off of the arms, the pocket being aligned with the piece of foam plastic in as far as the piece of foam plastic has not completely reassumed its original shape.

2. Process as claimed in claim 1 wherein the foam plastic has closed cells.

3. Process as claimed in claim 1 wherein, upon pulling the pocket with the piece of foam plastic contained therein off of the two arms, a pressure is exerted on the pocket in the direction of pulling off right through the opening.

4. Process as claimed in claim wherein at least one piece of foam plastic is used, wherein the piece of foam plastic has closed cells, and wherein the involved pockets are those of a life jacket.

* * * * *